United States Patent [19]

Jahnke et al.

[11] 4,351,089

[45] Sep. 28, 1982

[54] NEEDLE BAR DRAW FRAME

[75] Inventors: Joachim Jahnke, Lübeck; Günther Lehming, Pogeez; Helmut Kunig, Hamburg; Jens Nagel, Mölln, all of Fed. Rep. of Germany

[73] Assignee: Nordischer Maschinenbau Rud. Baader, Lübeck, Fed. Rep. of Germany

[21] Appl. No.: 169,923

[22] Filed: Jul. 17, 1980

[51] Int. Cl.[3] ..... D01G 19/00; D01G 5/14

[52] U.S. Cl. ..... 19/129 R; 19/129 A

[58] Field of Search ..... 19/126, 127, 129 R, 19/129 A, 236, 244, 248

[56] References Cited

U.S. PATENT DOCUMENTS 10,913 5/1854 Sargent ..... 19/127

FOREIGN PATENT DOCUMENTS 611914 4/1935 Fed. Rep. of Germany .
7426839 10/1975 Fed. Rep. of Germany .
442338 4/1912 France ..... 19/129 A
468000 6/1914 France ..... 19/129 A
4231 of 1883 United Kingdom ..... 19/127
962049 6/1964 United Kingdom ..... 19/129 R

OTHER PUBLICATIONS

"Mechanische Spinnerei", (Mechanical Spinning) by Werner Oeser, published by Schiele and Schon, Berlin, 1971, pp. 66–71.

*Primary Examiner*—Louis Rimrodt
*Attorney, Agent, or Firm*—Edward F. Levy

[57] ABSTRACT

The invention concerns a needle bar draw frame or gill box with a needle field or gilling area of needle bars carried by chains. With the aim of attaining the usual performances in respect of speed and drawing ratio at the same quality also in the case of voluminous short-staple slivers with draw frames operating with an upper and a lower needle field, control means engaging from above into the needle field are used in a draw frame provided merely with a lower needle field. These control means are constructed as bristle-like holding down devices which are arranged particularly immediately upstream of a pair of drawing rollers and possibly shortly downstream of a pair of entry rollers, while the central region is controlled in the usual manner by a bar roller or bar chain.

5 Claims, 4 Drawing Figures

31
41
45
43
44
1
7
15
14
21
13
11
32
12
22

41
42

51
5
52

61
64
63
62
6.

NEEDLE BAR DRAW FRAME

BACKGROUND OF THE INVENTION

1. Field of the Invention

The invention relates to a needle bar draw frame, also termed or known as gill box for slivers comprising a needle field resp. gill area of needle bars carried by chains, entry rollers lying upstream of the needle field, drawing rollers disposed downstream of the needle field, and controlling elements for the slivers arranged above the needle field and extending resp. dipping in between the needles of the needle bars.

2. Description of Prior Art

Needle bar draw frames with an upper needle field as a controlling element enable bringing the fibres in agreeable parallelism and homogenising a fed sliver correctly, but also present a series of disadvantages. E.g., it is not possible in the case of a double draw field consisting of a lower and an upper needle field to achieve an adequately short nip for the processing particularly of short-staple slivers, which is the reason that the degree of parallelism attainable in the processing of long-staple slivers cannot be reached thereby. Although this disadvantage may be avoided when using single needle fields, it is, however, substituted by another disadvantage, which lies in that the sliver dipping into the needle field tends to extend beyond the tips of the needles, whereby parts of the sliver are withdrawn from the influence of the needles. Therefore, controlling elements have been arranged in the shape of one or more cage cylinders or rollers above the needle field, as disclosed by DE-GM No. 74 26 839, which are driven at a peripheral speed corresponding to the advancing motion of the needle field and, with their bars, protrude between the needle rows of the needle field.

Furthermore DE-PS No. 611 914 discloses a needle bar draw frame, in which a bar belt is mounted above the needle field, the bars of which in like manner protrude between the needle rows of the needle field.

The desired effect is however attained only in part by these devices, because it has become evident that due to the constructional conditions, a zone not controllable by these means remains shortly before the take-off roller pair, which makes a processing particularly of short-staple slivers more difficult.

3. Object of the Invention

It is therefore a main object of the invention to remove this defect by improving the known needle bar draw frames with single needle field so that they are in a position of attaining the intended perfect effect of parallelism of the fibres even in the case of voluminous slivers with short-staple fibres at high delivery speeds and high drafts.

BRIEF SUMMARY OF THE INVENTION

According to the invention this object is achieved by at least one holding down device, which is provided with a plurality of resiliently yielding bristles and arranged locally fixed above the needle field as a controlling element on its own or in connection with others, the bristles being inclined in the direction of motion of the needle field. Thereby, a control of the needle field in its entire extent lets itself be attained in a simple manner and a high degree of parallelism and homogenization can thus be achieved.

In the processing of extremely short-staple slivers, the arrangement of one of the holding down devices closely in front of the drawing rollers at the end of the needle field acts particularly advantageously due to the control attainable thereby of the sliver immediately up to the drawing rollers.

The arrangement of one of the holding down devices immediately downstream of the entry rollers, i.e. in the region of the decompression of the sliver after its release from the entry rollers improves the effectiveness of the holding down device disposed closely in front of the drawing rollers.

In the processing of particularly voluminous slivers, a bar roller or cylinder or a bar chain may be arranged as a further controlling element beside that arranged closely in front of the drawing rollers above the needle field and be driven to circulate synchronously with the chains thereof.

BRIEF DESCRIPTION OF THE DRAWINGS

Other and further objects of the present invention will be apparent from the following description and claims and are illustrated in the accompanying schematic drawings, which, by way of illustration, show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims.

The drawings show in

DETAILED DESCRIPTION OF THE PREFERRED EMBODIMENT

Figure 1:
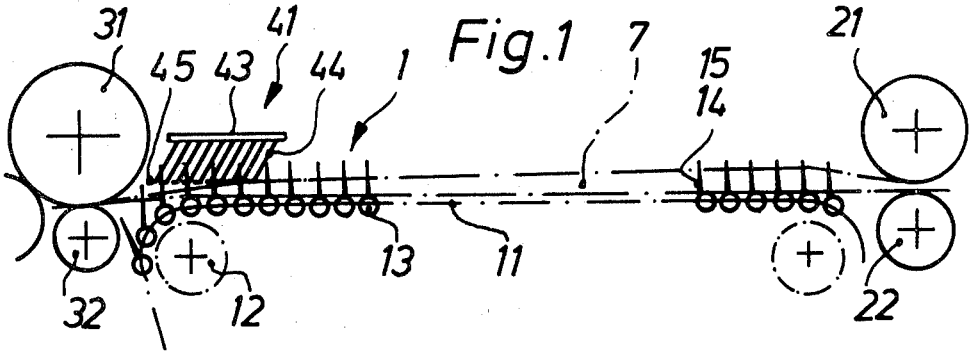
FIG. 1 a side elevation of a needle bar draw frame resp. gill box with one holding down device, FIG. 2 a side elevation of another needle bar draw frame embodiment with two holding down devices, FIG. 3 a side elevation of another needle bar draw frame embodiment with a holding down device according to FIG. 1 and a bar roller, and FIG. 4 a side elevation of another needle bar draw frame embodiment with a holding down device according to FIG. 1 and a bar chain belt.
Figure 2:
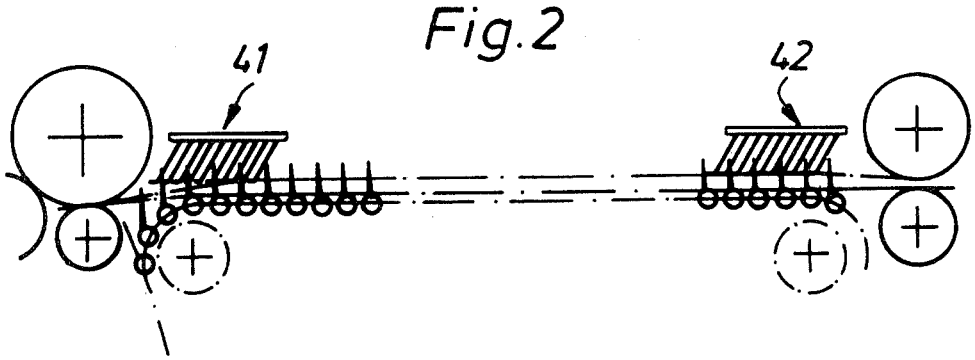

In a not illustrated machine frame or gill box, a gill area or needle field 1 is arranged between a pair of entry rollers 21 and 22 as well as a pair of drawing rollers 31 and 32 and formed by needle bars 13 carried by endless chains 11. The chains 11 are guided around wheels, by which they are deflected, held tensioned and driven and of which deflecting wheels 12 are arranged immediately in front of the drawing rollers at the end of the needle field 1. The needle bars 13, their guides and control cams are executed in a known per se manner and thus not illustrated. Each needle bar 13 carries one row 14 of needles 15 in the figurative illustrations, can, however, in case of need also be provided with more than one row of needles. Arranged closely in front of the upper drawing roller 31 above the needle field 1 and in the proximity of its end is a holding down device 41, comprising a carrier 43 and a field of bristles 44, which are arranged closely beside and behind one another and which can consist of a synthetic or metallic material of great toughness and elasticity and which are inclined in the direction of motion of the needle field 1. The bristles 44 have points 45, by which they protrude at different depths in accordance with the required setting between the needles 15 of the needle bars 13 of the needle field 1. In FIG. 2, a further identically or similarly structured holding down device 42 is disposed at the start of the needle field 1.

Figure 3:
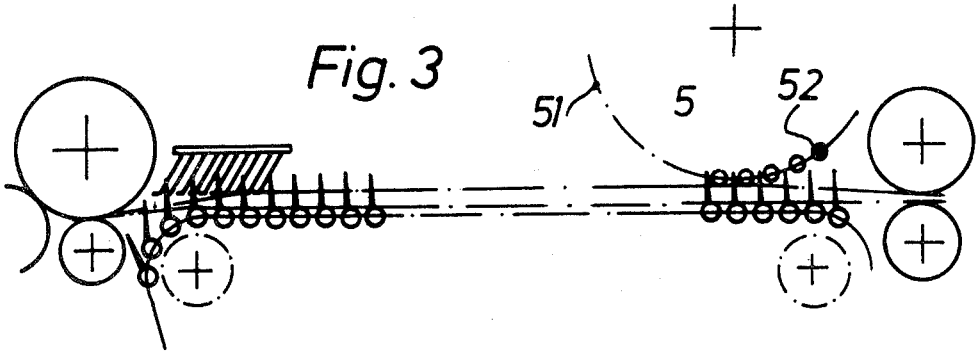

In place of the holding down device 42, a bar roller 5 is arranged at the start of the needle field 1 in the embodiment of FIG. 3 and protrudes by its bars 52 carried by its wheel rims 51 between the needle rows 14 of the needle bars 13 of the needle field 1.

Figure 4:
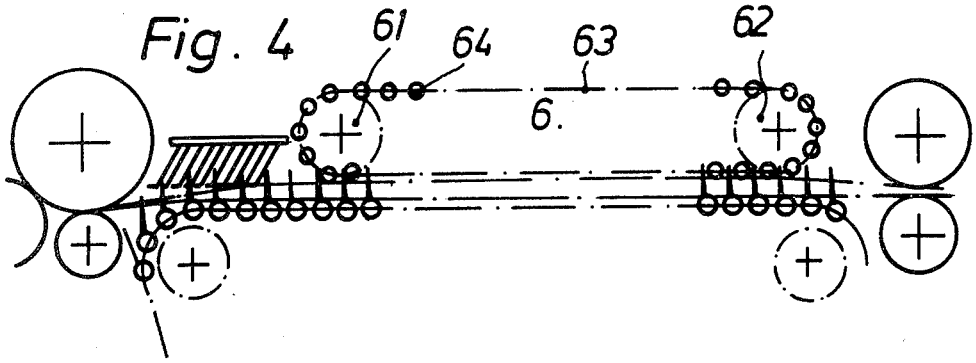

In place of the holding down device 42 or the bar roller 5 there is arranged a bar chain belt 6 in FIG. 4, which belt extends from the start of the needle field 1 up to the holding down device 41 and dips by the bars 64 carried by its chains 63 between the needle rows 14 of the needle bars 13 of the needle field 1. The chains 63 are guided around rollers 61 and 62.

The function of the needle bar draw frame according to the invention is the following:

A textile sliver 7 advanced through the entry rollers 21 and 22 is stretched by the drawing rollers 31 and 32 circulating at a higher peripheral speed than the entry rollers 21, 22, while its fibres are embedded in the needle field 1. At the end of the needle field 1, the greatly drawn fibres of the sliver 7 are held pressed by the bristles 44 of the holding down device 41 up to their release by the needles 15 of the needle field 1 between these and in this manner make possible a controlled exit of the sliver 7 from the needle field 1 and entrance between the drawing rollers 31 and 32. When the species of the fibres or the composition of the sliver 7 make necessary an exact control already at the start of the needle field 1, one may use the holding down device 42 of FIG. 2. In the case of very voluminous slivers 7, a holding down device 42 is, however, only conditionally suitable so that a bar cylinder 5 according to FIg. 3 may be used more advantageously, the bars 52 of which also bring bulgy and voluminous slivers securely between the needles 15 of the needle field 1.

In the case of short-staple and voluminous slivers 7 or also staples with bulky fibres, an embodiment according to FIG. 4 is particularly suitable, in which the fibres are brought between the needles 15 by the bars 64 of the bar chain belt 6 not only at the start of the needle field 1, but are also held over the greatest part of the drawing path.

Needle bar draw frames resp. gill boxes constructed according to the invention deliver drawn slivers with a performance, a draft and a quality, which are hitherto attainable merely by needle bar draw frames which operate on the intersecting principle with an upper and lower needle field.

What we claim as our invention and desire to secure by Letters Patent is:

1. Needle bar draw frame or gill box for slivers comprising needle field or gill area means of needle bars carried by chains for continuous uninterrupted movement and having spaced upstanding needles, entry roller means lying upstream of said needle field means, drawing roller means disposed downstream of said needle field means and controlling means for said slivers arranged above said needle field means and dipping in between the needles of said needle bars, wherein said controlling means includes at least one holding down device provided with a plurality of depending resiliently yielding bristles and mounted in a stationary position above said needle field means with said bristles projecting between said needles and being inclined in the direction of motion of said needle field means.

2. Needle bar draw frame according to claim 1 wherein one of the holding down devices is arranged closely upstream of said drawing roller means at the end of said needle field means.

3. Needle bar draw frame according to claim 1 wherein one of said holding down devices is arranged closely downstream of said entry roller means at the start of said needle field means.

4. Needle bar draw frame according to any of claims 1 to 3 wherein said controlling means also includes a bar roller arranged beside the holding down device above the needle field and driven to circulate sychronously with said chains.

5. Needle bar draw frame according to any of claims 1 to 3 wherein said controlling means also includes a bar chain arranged beside the holding down device above the needle field and driven to circulate sychronously with said chains.

* * * * *